US007351872B2

(12) United States Patent
Stell et al.

(10) Patent No.: US 7,351,872 B2
(45) Date of Patent: Apr. 1, 2008

(54) PROCESS AND DRAFT CONTROL SYSTEM FOR USE IN CRACKING A HEAVY HYDROCARBON FEEDSTOCK IN A PYROLYSIS FURNACE

(75) Inventors: Richard C. Stell, Houston, TX (US); Subramanian Annamalai, Singapore (SG); James M. Frye, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 577 days.

(21) Appl. No.: 10/851,495

(22) Filed: May 21, 2004

(65) Prior Publication Data

US 2005/0261534 A1 Nov. 24, 2005

(51) Int. Cl.
*C07C 4/02* (2006.01)
*C10G 9/36* (2006.01)

(52) U.S. Cl. ..... 585/652; 585/648; 208/130

(58) Field of Classification Search ..... 585/652, 585/648; 208/130
See application file for complete search history.

(56) References Cited

U.S. PATENT DOCUMENTS

| | | | | |
|---|---|---|---|---|
| 1,936,699 | A | 11/1933 | Weaver | |
| 1,984,569 | A | 12/1934 | Cooke et al. | 196/66 |
| 2,091,261 | A | 8/1937 | Alther | 196/49 |
| 2,158,425 | A | 5/1939 | Ragatz | 196/73 |
| 3,291,573 | A | 12/1966 | Frescoln | |
| 3,341,429 | A | 9/1967 | Fondrk | |
| 3,413,211 | A | 11/1968 | Becraft et al. | 208/93 |
| 3,487,006 | A | 12/1969 | Newman et al. | 208/93 |
| 3,492,795 | A | 2/1970 | Guerrieri | |
| 3,505,210 | A | 4/1970 | Wallace et al. | |
| 3,617,493 | A | 11/1971 | Wirth et al. | 208/80 |
| 3,677,234 | A | 7/1972 | Dutkiewicz | |
| 3,718,709 | A | 2/1973 | Simonetta | 260/683 R |
| 3,900,300 | A | 8/1975 | Lehman | |

(Continued)

FOREIGN PATENT DOCUMENTS

DE 10 93 351 11/1960

(Continued)

OTHER PUBLICATIONS

"Specialty Furnace Design: Steam Reformers and Steam Crackers", presented by T.A. Wells of the M.W. Kellogg Company, 1988 AIChE Spring National Meeting.

(Continued)

*Primary Examiner*—Thuan Dinh Dang

(57) ABSTRACT

A process and control system for cracking a heavy hydrocarbon feedstock containing non-volatile hydrocarbons comprising heating the heavy hydrocarbon feedstock, mixing the heated heavy hydrocarbon feedstock with a dilution steam stream to form a mixture stream having a vapor phase and a liquid phase, separating the vapor phase from the liquid phase in a separation vessel, and cracking the vapor phase in the furnace, wherein the furnace draft is continuously measured and periodically adjusted to control the temperature of the stream entering the vapor/liquid separator and thus controlling the ratio of vapor to liquid separated in the separation vessel; and wherein in a preferred embodiment the means for adjusting the draft comprises varying the speed of at least one furnace fan, possibly in combination with adjusting the position of the furnace fan damper(s) or the furnace burner dampers(s).

27 Claims, 2 Drawing Sheets

U.S. PATENT DOCUMENTS

| | | | | |
|---|---|---|---|---|
| 4,199,409 | A | 4/1980 | Skraba | |
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,332,546 | A * | 6/1982 | Bacsik | 431/5 |
| 4,361,478 | A | 11/1982 | Gengler et al. | |
| 4,400,182 | A | 8/1983 | Davies et al. | |
| 4,426,278 | A | 1/1984 | Kosters | 208/130 |
| 4,543,177 | A | 9/1985 | Murthy et al. | 208/130 |
| 4,615,795 | A | 10/1986 | Woebcke et al. | 208/72 |
| 4,714,109 | A | 12/1987 | Tsao | |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | |
| 5,096,567 | A | 3/1992 | Paspek, Jr. et al. | 208/106 |
| 5,120,892 | A | 6/1992 | Skraba | 585/652 |
| 5,141,906 | A | 8/1992 | Takeshima et al. | |
| 5,190,634 | A | 3/1993 | Fernandez-Baujin et al. | 208/107 |
| 5,468,367 | A | 11/1995 | Dickakian | |
| 5,580,443 | A | 12/1996 | Yoshida et al. | 208/130 |
| 5,817,226 | A | 10/1998 | Lenglet | |
| 5,910,440 | A | 6/1999 | Grossman et al. | |
| 6,093,310 | A | 7/2000 | Swan | |
| 6,123,830 | A | 9/2000 | Gupta et al. | |
| 6,179,997 | B1 | 1/2001 | Vedder, Jr. et al. | 208/113 |
| 6,190,533 | B1 | 2/2001 | Bradow et al. | |
| 6,210,351 | B1 | 4/2001 | Korenaga et al. | |
| 6,303,842 | B1 | 10/2001 | Bridges et al. | |
| 6,376,732 | B1 | 4/2002 | Ngan et al. | |
| 6,632,351 | B1 | 10/2003 | Ngan et al. | 208/132 |
| 6,743,961 | B2 | 6/2004 | Powers | |
| 2001/0016673 | A1 | 8/2001 | Bridges et al. | |
| 2003/0070963 | A1 | 4/2003 | Zimmermann et al. | |
| 2004/0004022 | A1 | 1/2004 | Stell et al. | 208/106 |
| 2004/0004027 | A1 | 1/2004 | Spicer et al. | 208/130 |
| 2004/0004028 | A1 | 1/2004 | Stell et al. | 208/130 |
| 2004/0039240 | A1 | 2/2004 | Powers | |
| 2004/0054247 | A1 | 3/2004 | Powers | |
| 2005/0010075 | A1 | 1/2005 | Powers | |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2 006 259 | 10/1977 |
| GB | 2 012 176 | 11/1977 |
| NL | 7410163 | 4/1975 |
| SU | 1491552 | 7/1989 |
| WO | WO 01/55280 | 8/2001 |
| WO | WO 2004/005433 | 1/2004 |
| ZA | 907394 | 7/1991 |

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16, 1991.

* cited by examiner 64
60
62
speed
5
6
1
2
52
8
10
50
24
B
12
98
14
56
80
87
46
54
D
22
48
16
C
26
20
18
A2
pres. diff.
32
44
A1
A3
42
28
30
40
36
34
3
4

64
60
62
speed
65
5
6
1
2
70
92
72
80
76
78
52
50
8
94
74
86
24
84
88
B
90
12
14
56
80
87
46
54
D
22
48
C
20
26
18
16
pres. diff.
32
44
28
42
30
40
36
34
3
4

PROCESS AND DRAFT CONTROL SYSTEM FOR USE IN CRACKING A HEAVY HYDROCARBON FEEDSTOCK IN A PYROLYSIS FURNACE

FIELD OF THE INVENTION

The present invention relates to a process and system for controlling the draft in a pyrolysis furnace which is cracking a hydrocarbon feedstock, and in particular a heavy hydrocarbon feedstock.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light or low molecular weight feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products, including olefins, leave the pyrolysis furnace for further downstream processing, including quenching.

Conventional steam cracking systems have been effective for cracking high-quality feedstocks such as gas oil and naphtha. However, steam cracking economics sometimes favor cracking low cost heavy feedstock such as, by way of non-limiting examples, crude oil and atmospheric resid, also known as atmospheric pipestill bottoms. Crude oil and atmospheric resid contain high molecular weight, non-volatile components with boiling points in excess of 590° C. (1100° F.). The non-volatile, heavy ends of these feedstocks lay down as coke in the convection section of conventional pyrolysis furnaces. Only very low levels of non-volatiles can be tolerated in the convection section downstream of the point where the lighter components have fully vaporized. Additionally, some naphthas are contaminated with crude oil or resid during transport. Conventional pyrolysis furnaces do not have the flexibility to process resids, crudes, or many resid or crude contaminated gas oils or naphthas, which contain a large fraction of heavy non-volatile hydrocarbons.

The present inventors have recognized that in using a flash to separate heavy non-volatile hydrocarbons from the lighter volatile hydrocarbons which can be cracked in the pyrolysis furnace, it is important to maximize the non-volatile hydrocarbon removal efficiency. Otherwise, heavy, coke-forming non-volatile hydrocarbons could be entrained in the vapor phase and carried overhead into the furnace creating coking problems.

Additionally, during transport some naphthas are contaminated with heavy crude oil containing non-volatile components. Conventional pyrolysis furnaces do not have the flexibility to process residues, crudes, or many residue or crude contaminated gas oils or naphthas which are contaminated with non-volatile components.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 230 and 590° C. (450 and 1100° F.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

Co-pending U.S. application Ser. No. 10/188,461 filed Jul. 3, 2002, patent application Publication US 2004/0004022 A1, published Jan. 8, 2004, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water.

U.S. patent application Ser. No. 60/555,282, filed Mar. 22, 2004, which is incorporated herein by reference, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins, and the product effluent cooled in a transfer line exchanger, wherein the amount of fluid mixed with the feedstock is varied in accordance with a selected operating parameter of the process, e.g., temperature of the mixture stream before the mixture stream is flashed.

Co-pending U.S. application Ser. No. 10/189,618 filed Jul. 3, 2002, patent application Publication US 2004/0004028 A1, published Jan. 8, 2004, which is incorporated herein by reference, describes an advantageously controlled process to increase the non-volatile removal efficiency in a flash drum in the steam cracking system wherein gas flow from the convection section is converted from mist flow to annular flows before entering the flash drum to increase the removal efficiency by subjecting the gas flow first to an expender and then to bends, forcing the flow to change direction. This coalesces fine liquid droplets from the mist.

When using a vapor/liquid separation apparatus such as a flash drum to separate the lighter volatile hydrocarbons as vapor phase from the heavy non-volatile hydrocarbon as liquid phase, it is important to carefully control the ratio of vapor to liquid leaving the flash drum. Otherwise valuable lighter fractions of the hydrocarbon feedstock could be lost in the liquid hydrocarbon bottoms or heavy, coke-forming components could be vaporized and carried as overhead into the furnace causing coke problems.

The control of the ratio of vapor to liquid leaving the flash drum has been found to be difficult because many variables are involved. The ratio of vapor to liquid is a function of the hydrocarbon partial pressure in the flash drum and also a function of the temperature of the stream entering the flash drum. The temperature of the stream entering the flash drum varies as the furnace load changes. The temperature is higher when the furnace is at full load and is lower when the furnace is at partial load. The temperature of the stream entering the flash drum also varies according to the flue gas temperature in the furnace that heats the feedstock. The flue-gas temperature in turn varies according to the extent of coking that has occurred in the furnace. When the furnace is clean or very lightly coked, the flue-gas temperature is lower than when the furnace is heavily coked. The flue-gas temperature is also a function of the combustion control exercised on the burners of the furnace. When the furnace is operated with low levels of excess oxygen in the flue gas, the flue gas temperature in the mid to upper zones of the convection section will be lower than that when the furnace is operated with higher levels of excess oxygen in the flue-gas. With all these variables, it is difficult to control a constant ratio of vapor to liquid leaving the flash drum.

The present invention offers an advantageously controlled process to optimize the cracking of volatile hydrocarbons contained in the heavy hydrocarbon feedstocks and to reduce and avoid the coking problems. The present invention provides a method to maintain a relatively constant ratio of vapor to liquid leaving the flash by maintaining a relatively constant temperature of the stream entering the flash. More specifically, the constant temperature of the flash stream is controlled by periodically adjusting the draft in the pyrolysis furnace, where the draft to control flue gas oxygen is the measure of the difference in the pressure of the flue gas in the furnace and the pressure outside of the furnace.

SUMMARY OF THE INVENTION

The present invention provides a process and control system for cracking a heavy hydrocarbon feedstock containing non-volatile hydrocarbons comprising heating the heavy hydrocarbon feedstock, mixing the heated heavy hydrocarbon feedstock with a dilution steam stream to form a mixture stream having a vapor phase and a liquid phase, separating the vapor phase from the liquid phase in a separation vessel, and cracking the vapor phase in the furnace.

The furnace has draft which is continuously measured and periodically adjusted to control the temperature of the stream entering the separation vessel and thus control the ratio of vapor to liquid separated in the separation vessel. In a preferred embodiment, the means for adjusting the draft comprises varying the speed of at least one furnace fan, possibly in combination with adjusting the position of the furnace fan damper(s) or the furnace burner dampers(s).

The process further comprises measuring the temperature of the vapor phase after the vapor phase is separated from the liquid phase; comparing the vapor phase temperature measurement with a pre-determined vapor phase temperature; and adjusting the draft in said furnace in response to said comparison.

In one embodiment, the temperature of the hot mixture stream can be further controlled by varying at least one of the flow rate or the temperature of the primary dilution steam stream. In another embodiment, the heated heavy hydrocarbon feedstock can also be mixed with a fluid prior to separating the vapor phase from the liquid phase, and the fluid can be at least one of liquid hydrocarbon and water. The temperature of the hot mixture stream can be further controlled by varying the flow rate of the fluid mixed with the heated hydrocarbon feedstock. The temperature of said hot mixture stream can also be further controlled by varying the flow rate of both the primary dilution steam stream and the flow rate of the fluid mixed with said heated heavy hydrocarbon feedstock.

In another embodiment, a secondary dilution steam stream is superheated in the furnace and at least a portion of the secondary dilution steam stream is then mixed with said hot mixture stream before separating the vapor phase from the liquid phase. With this embodiment, the temperature of the hot mixture stream can be further controlled by varying the flow rate and temperature of the secondary dilution steam stream. A portion of the superheated secondary dilution steam stream can be mixed with said vapor phase after separating said vapor phase from said liquid phase.

The use of primary dilution steam stream is optional for very high volatility feedstocks (e.g., ultra light crudes and contaminated condensates). It is possible that such feedstocks can be heated in the convection section, forming a vapor and a liquid phase and which is conveyed as heated hydrocarbon stream directly to the separation vessel without mixing with dilution steam. In that embodiment, the vapor phase and the liquid phase of the heated hydrocarbon feedstock will be separated in a separation vessel and the vapor phase would be cracked in the radiant section of the furnace. The furnace draft would be mixed with dilution steam and continuously measured and periodically adjusted to control the temperature of at least one of the heated hydrocarbon stream and the vapor phase separated from the liquid phase.

DETAILED DESCRIPTION OF THE INVENTION

Figure 1:
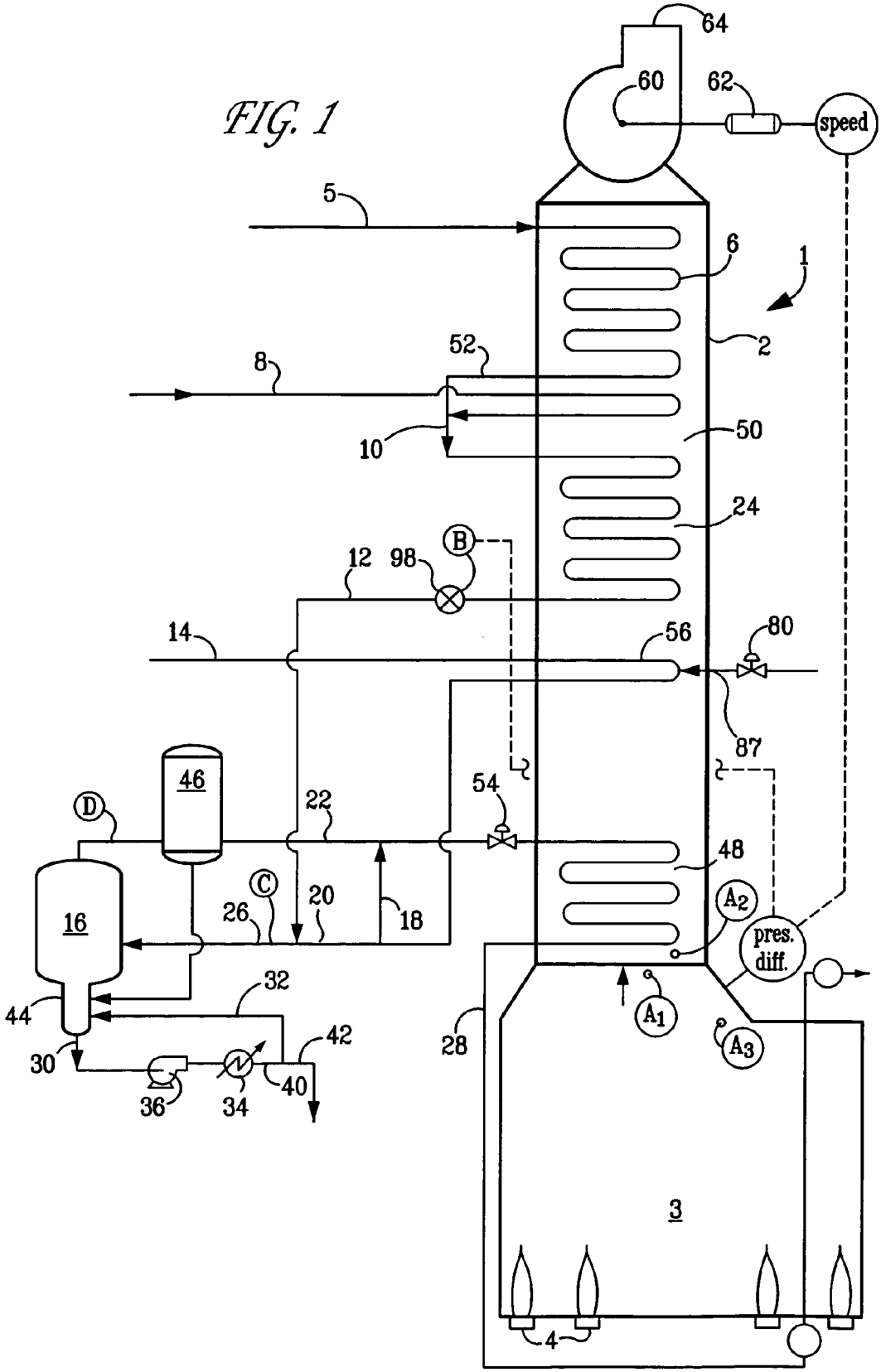
FIG. 1 illustrates a schematic flow diagram of a process and control system of one embodiment of the present invention employing at least one furnace fan.

The present invention relates to a process and "draft" control system for use in a pyrolysis furnace while cracking a hydrocarbon feedstock, and in particular a heavy hydrocarbon feedstock. The present invention provides a method to maintain a relatively constant ratio of vapor to liquid leaving the flash or vapor/liquid separation vessel by maintaining a relatively constant temperature of the stream entering the vapor/liquid separation vessel. More specifically, the temperature of the hot mixture stream, vapor stream or flash stream can be adjusted and maintained by periodically adjusting the draft in the pyrolysis furnace, where the draft is the measure of the difference in pressure of the flue gas in the furnace and the pressure outside the furnace. The draft is used to control the flue gas oxygen in the furnace and thus the temperature of the stream entering the vapor/liquid separation vessel.

The hydrocarbon feedstock to the furnace can comprise a large portion, such as about 2 to about 50%, of non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, C4's/residue admixture, naphtha/residue admixture, hydrocarbon gases/residue admixtures, hydrogen/residue admixtures, gas oil/residue admixture, and crude oil.

As used herein, non-volatile components, or resids, are the fraction of the hydrocarbon feed with a nominal boiling point above 590° C. (1100° F.) as measured by ASTM D-6352-98 or D-2887. This invention works very well with non-volatiles having a nominal boiling point above 760° C. (1400° F.). The boiling point distribution of the hydrocarbon feed is measured by Gas Chromatograph Distillation (GCD) by ASTM D-6352-98 or D-2887 extended by extrapolation for materials boiling above 700° C. (1292° F.). Non-volatiles include coke precursors, which are large molecules that condense in the vapor, and then form coke under the operating conditions encountered in the present process of the invention.

The hydrocarbon feedstock can have a nominal end boiling point of at least about 315° C. (600° F.), generally greater than about 510° C. (950° F.), typically greater than about 590° C. (1100° F.), for example greater than about 760° C. (1400° F.). The economically preferred feedstocks are generally low sulfur waxy residues, atmospheric residues, naphthas contaminated with crude, various residue admixtures and crude oils.

One embodiment of the process and draft control system can be described by reference to FIG. 1 which illustrates a furnace 1 having a convection section 2 and a radiant section 3. The radiant section 3 has radiant section burners 4 which provide hot flue gas in the furnace 1. The process comprises first heating a heavy hydrocarbon feedstock stream 5 in the convection section 2 of the furnace 1. The heavy hydrocarbon feedstock is heated in the upper convection section 50 of the furnace 1. The heating of the heavy hydrocarbon feedstock can take any form known by those of ordinary skill in the art. It is preferred that the heating comprises indirect contact of the feedstock in the convection section 2 of the furnace 1 with hot flue gases from the radiant section 3 of the furnace 1. This can be accomplished, by way of non-limiting example, by passing the heavy hydrocarbon feedstock through a bank of heat exchange tubes 6 located within the upper convection section 50 of the pyrolysis furnace 1. The heated heavy hydrocarbon feedstock 52 has a temperature between about 300° F. to about 650° F. (150° C. to about 345° C.).

The heated heavy hydrocarbon feedstock is then mixed with a primary dilution steam stream 8 to form a mixture stream 10. The primary dilution steam stream 8 is preferably superheated in the convection section 2 of the furnace 1, and is preferably at a temperature such that it serves to partially vaporize the heated heavy hydrocarbon feedstock. The use of primary dilution steam stream 8 is optional for very high volatility feedstocks 5 (e.g., ultra light crudes and contaminated condensates). It is possible that such feedstocks can be heated in tube bank 6 forming a vapor and a liquid phase which is conveyed as heated hydrocarbon stream 12 directly to the separation vessel 16 without mixing with dilution steam 8.

The mixture stream 10 is heated again in the furnace 1. This heating can be accomplished, by way of non-limiting example, by passing the mixture stream 10 through a bank of heat exchange tubes 24 located within the convection section 2 of the furnace I and thus heated by the hot flue gas from the radiant section 3 of the furnace 1. The thus-heated mixture leaves the convection section 2 as a hot mixture stream 12 having a vapor phase and a liquid phase which are ultimately separated in separation vessel 16, which in FIG. 1 is illustrated as a knock-out or flash drum.

Optionally, a secondary dilution steam stream 14 is heated in the convection section 2 of the furnace 1 and is then mixed with the hot mixture stream 12. The secondary dilution steam stream 14 is optionally split into a flash steam stream 20 which is mixed with the hot mixture stream 12 (before separating the vapor from the liquid in the separation vessel 16) and a bypass steam stream 18 (which bypasses the separation vessel 16) and, instead is mixed with the vapor phase stream 22 from the separation vessel 16 before the vapor phase is cracked in the radiant section 3 of the furnace 1. This embodiment can operate with all secondary dilution steam 14 used as flash steam stream 20 with no bypass steam stream 18. Alternatively, this embodiment can be operated with secondary dilution steam stream 14 directed entirely to bypass steam stream 18 with no flash steam stream 20.

In a preferred embodiment in accordance with the present invention, the ratio of the flash steam stream 20 to the bypass steam stream 18 should be preferably 1:20 to 20:1, and most preferably 1:2 to 2:1. The flash steam stream 20 is mixed with the hot mixture stream 12 to form a flash stream 26 before separating the vapor from the liquid in the separation vessel 16. Preferably, the secondary dilution steam stream 14 is superheated in a superheater tube bank 56 in the convection section 2 of the furnace 1 before splitting and mixing with the hot mixture stream 12. The addition of the flash steam stream 20 to the hot mixture stream 12 ensures the vaporization of an optimal fraction or nearly all volatile components of the hot mixture stream 12 before the flash stream 26 enters the separation vessel 16.

The hot mixture stream 12 (or flash stream 26 as previously described) is then introduced into a separation vessel 16 for separation into two phases: a vapor phase comprising predominantly volatile hydrocarbons and a liquid phase comprising predominantly non-volatile hydrocarbons. In one embodiment, the vapor phase stream 22 is preferably removed from the flash drum as an overhead vapor stream 22. The vapor phase, preferably, is fed back to the lower convection section 48 of the furnace 1 for optional heating and conveyance by crossover pipes 28 to the radiant section 3 of the furnace 1 for cracking. The liquid phase of the separation is removed from the separation vessel 16 as a bottoms stream 30.

As previously discussed, it is preferred to maintain a predetermined constant ratio of vapor to liquid in the separation vessel 16. But such ratio is difficult to measure and control. As an alternative, the temperature B of the hot mixture stream 12 before entering the separation vessel 16 can be used as an indirect parameter to measure, control, and maintain the constant vapor to liquid ratio in the separation vessel 16. Ideally, when the hot mixture stream 12 temperature is higher, more volatile hydrocarbons will be vaporized and become available, as a vapor phase, for cracking. However, when the hot mixture stream 12 temperature is too high, more heavy hydrocarbons will be present in the vapor phase and carried over to the convection section 2 furnace tubes, eventually coking the tubes. If the hot mixture stream 12 temperature is too low, hence a low ratio of vapor to liquid in the separation vessel 16, more volatile hydrocarbons will remain in liquid phase and thus will not be available for cracking.

The hot mixture stream 12 temperature is limited by highest recovery/vaporization of volatiles in the heavy hydrocarbon feedstock while avoiding coking in the furnace tubes or coking in piping and vessels conveying the mixture from the separation vessel 16 to the furnace 1. The pressure drop across the piping and vessels conveying the mixture to the lower convection section 48, and the crossover piping 28, and the temperature rise across the lower convection section 48 may be monitored to detect the onset of coking. For instance, when the crossover pressure and process inlet pressure to the lower convection section 48 begins to increase rapidly due to coking, the temperature in the separation vessel 16 and the hot mixture stream 12 should be reduced. If coking occurs in the lower convection section 48, the temperature of the flue gas to the superheater section 56 increases, requiring more desuperheater water 80 to control the temperature in lines 18 and 20.

Typically, the temperature of the hot mixture stream 12 is set and controlled at between 600 and 1040° F. (310 and 560° C.), preferably between 700 and 920° F. (370 and 490° C.), more preferably between 750 and 900° F. (400 and 480° C.), and most preferably between 810 and 890° F. (430 and 475° C.). These values will change with the volatility of the feedstock as discussed above.

As previously noted, the furnace draft is continuously measured by pressure differential instruments and periodically adjusted to control the temperature (B, D, and C, respectively) of at least one of the hot mixture stream 12, the vapor stream 22 and the flash stream 26. FIG. 1 illustrates the control system 98 which comprises a temperature sensor that periodically adjusts the temperature for the mixture stream 12 in connection with the furnace draft measurement. In this embodiment, the control system 98 comprises at least a temperature sensor and any known control device, such as a computer application. The furnace 1 draft is the difference in the pressure of the flue gas in the furnace 1. For safety reasons, draft measurement is extremely important. If the draft is too low or non-existent, it may result in extremely dangerous operations where the hot radiant flue gas flows from the radiant section 3 to the environment. To ensure that the flue gas only exits the furnace 1 at the top of the stack 64, it is measured at the location where it is a minimum. Typically, the minimum draft location, measured at points $A_1$, $A_2$ or $A_3$, can be anywhere between the top of the radiant section 3 and the first row of tubes in the lower convection section 48. The location of minimum draft moves depending on furnace 1 operations. To ensure safe operation of the furnace 1, the draft set point is higher than required for optimal thermal efficiency of furnace 1. This ensures that the furnace 1 will run safely during upsets in operation of the furnace 1.

The inventive process and draft control system for controlling the temperature of at least one of the hot mixture stream 12, vapor stream 22, and flash stream 26 in order to achieve an optimum vapor/liquid separation in separation vessel 16 is determined based on the volatility of the feedstock as described above. In typical operations with heavy hydrocarbon feedstocks, the draft is set at about 0.15 to 0.25" wc (wc stands for water column, a convenient measure of very small differences in pressure).

Once the furnace 1 is operating, the temperature B of the hot mixture stream 12 is measured (alternatively, the temperature C of the flash stream 26 or the temperature D of the vapor stream 22 is measured) and if that temperature is lower than the desired temperature, then the set point of the draft will be increased. An increase in the set-point draft will, through the means for adjusting the draft, cause an increase in the excess flue gas oxygen in the furnace, which will cause the temperature in the furnace 1 to increase. This will ultimately result in an increase in the temperature B of the hot mixture stream 12 (and thus an increase in the temperature C of the flash stream 26 and the temperature D of the vapor stream 22).

As shown in FIG. 1, the speed of the furnace fan 60 is varied in response to the change in the draft. For example, an increase in the speed of the furnace fan 60 will cause an increase in the draft, which will increase flue gas oxygen and thus will increase the temperature in the convection section 2. Other means comprise dampers to the burners (not illustrated), furnace stack dampers (see dampers 65, illustrated in FIG. 2) or any combination of the above. The speed of the furnace fan 60 is the fine tuning means for adjusting the draft and thus the excess oxygen in the furnace 1. If it becomes necessary to significantly increase the flue gas excess oxygen, then the furnace fan 60 speed can be increased to its maximum speed, which can result in too much draft, but may still not create enough flue gas oxygen. In this case, the dampers can be opened (this is typically done manually) at the burners 4 or at the fan 60 (see dampers 65 in FIG. 2), thus increasing excess oxygen in the flue gas and possibly reducing the draft in the furnace 1 and the required fan speed.

Use of the draft measurement as part of the control system is a very quick, "real-time" way to periodically adjust and control the temperature B of the hot mixture stream 12 (and the temperature C of the flash stream 26) and thus indirectly the ratio of vapor to liquid separated in the separation vessel 16. A change in the furnace fan 60 speed will almost immediately result in a change in the draft measurement because the pressure of the radiant section 3 responds rapidly to change in furnace fan 60 speed. Draft differential pressure instruments respond very quickly. On the other hand, measuring the excess oxygen is a problem because instruments for measuring excess oxygen respond more slowly to changes in furnace fan 60 speed because it takes a relatively long time for the higher oxygen flue gas to reach oxygen measuring instrument. Therefore, the immediately measurable draft response allows for the control system to quickly react to changes in furnace fan 60 speed which not only mitigates oscillations in the furnace operations, but also allow for a quick way to periodically adjust the temperature D in the hot mixture stream 12 (and the temperature C in the flash stream 26) and thus the vapor/liquid separation occurring in the separation vessel 16.

In addition to maintaining a constant temperature B of the hot mixture stream 12 (and the temperature C and D of the flash stream 26 and the vapor stream 22, respectively) entering the separation vessel 16, it is also desirable to maintain a constant hydrocarbon partial pressure of the separation vessel 16 in order to maintain a constant ratio of vapor to liquid separation. By way of examples, the constant hydrocarbon partial pressure can be maintained by maintaining constant separation vessel 16 pressure through the use of control valves 54 on the vapor phase line 22, and by controlling the ratio of steam to hydrocarbon feedstock in flash stream 26. Typically, the hydrocarbon partial pressure of the flash stream 26 in the present invention is set and controlled at between 4 and 25 psia (25 and 175 kPa), preferably between 5 and 15 psia (35 to 100 kPa), most preferably between 6 and 11 psia (40 and 75 kPa).

The separation of the vapor phase from the liquid phase is conducted in at least one separation vessel 16. Preferably, the vapor/liquid separation is a one-stage process with or without reflux. The separation vessel 16 is normally operated at 40-200 psia (275-1400 kPa) pressure and its temperature is usually the same or slightly lower than the temperature of the flash stream 26 before entering the separation vessel 16. Typically, for atmospheric resides, the pressure of the separation vessel 16 is about 40 to 200 psia (275-1400 kPa) and the temperature is about 600 to 950° F. (310 to 510° C.). Preferably, the pressure of the separation vessel 16 is about 85 to 155 psia (600 to 1100 kPa) and the temperature is about 700 to 920° F. (370 to 490° C.). More preferably, the pressure of the separation vessel 16 is about 105 to 145 psia (700 to 1000 kPa) and the temperature is about 750 to 900° F. (400 to 4800° C.). Most preferably, the pressure of the separation vessel 16 is about 105 to 125 psia (700 to 760 kPa) and the temperature is about 810 to 890° F. (430 to 480° C.). Depending on the temperature of the flash stream 26, usually 40 to 98% of the mixture entering the flash drum 16 is vaporized to the upper portion of the flash drum, preferably 60 to 90% and more preferably 65 to 85%, and most preferably 70 to 85%.

The flash stream 26 is operated, in one aspect, to minimize the temperature of the liquid phase at the bottom of the separation vessel 16 because too much heat may cause coking of the non-volatiles in the liquid phase. Use of the optional secondary dilution steam stream 14 in the flash stream 26 entering the separation vessel 16 lowers the vaporization temperature because it reduces the partial pressure of the hydrocarbons (i.e., larger mole fraction of the vapor is steam), and thus lowers the required liquid phase temperature. Alternatively, rather than using a secondary dilution steam stream 14, it may be possible to achieve the same result by adding more steam in the primary dilution steam stream 8.

It may also be helpful to recycle a portion of the externally cooled flash drum bottoms liquid 32 back to the separation vessel 16 to help cool the newly separated liquid phase at the bottom of the separation vessel 16. Liquid stream 30 is conveyed from the bottom of the separation vessel 16 to the cooler 34 via pump 36. The cooled stream 40 is split into a recycle stream 32 and export stream 42. The temperature of the recycled stream 32 is ideally 500 to 600° F. (260 to 320° C.). The amount of recycled stream 32 should be about 80 to 250% of the amount of the newly separated bottom liquid inside the separation vessel 16.

The separation vessel 16 is also operated, in another aspect, to minimize the liquid retention/holding time in the separation vessel 16. Preferably, the liquid phase is discharged from the vessel through a small diameter "boot" or cylinder 44 on the bottom of the separation vessel 16. Typically, the liquid phase retention time in the separation vessel 16 is less than 75 seconds, preferably less than 60 seconds, more preferably less than 30 seconds, and most preferably less than 15 seconds. The shorter the liquid phase retention/holding time in the separation vessel 16, the less coking occurs in the bottom of the separation vessel 16.

In the vapor/liquid separation, the vapor phase usually contains less than 100 ppm, preferably less than 80 ppm, and most preferably less than 50 ppm. The vapor phase is very rich in volatile hydrocarbons (for example, 55-70%) and steam (for example, 30-45%). The boiling end point of the vapor phase is normally below 1400° F. (760° C.), preferably below 1250° F. (675° C.). The vapor phase is continuously removed from the separation vessel 16 through an overhead pipe which conveys the vapor to an optional centrifugal separator 46 which removes trace amounts of entrained or condensed liquid. The vapor then flows into a manifold that distributes the flow to the lower convection section 48 of the furnace 1. The vapor phase stream 22 removed from the separation vessel 16 can optionally be mixed with a bypass steam 18 before being introduced into the lower convection section 48. The use of a centrifugal separator 46 is optional. The vapor phase stream 22 continuously removed from the separation vessel 16 is preferably superheated in the lower convection section 48 of the furnace 1 to a temperature of, for example, about 800 to 1300° F. (430 to 700° C.) by the flue gas from the radiant section 3 of the furnace 1. The vapor is then introduced to the radiant section 3 of the furnace 1 to be cracked.

The bypass steam stream 18 is a split steam stream from the secondary dilution steam 14. As previously noted, it is preferable to heat the secondary dilution steam 14 in the furnace 1 before splitting and mixing with the vapor phase stream removed from the separation vessel 16. In some applications, it may be possible to superheat the bypass steam stream 18 again after the splitting from the secondary dilution steam 14 but before mixing with the vapor phase. The superheating after the mixing of the bypass steam 18 with the vapor phase stream 22 ensures that all but the heaviest components of the mixture in this section of the furnace 1 are vaporized before entering the radiant section 3. Raising the temperature of vapor phase to 800 to 1300° F. (430 to 700° C.) in the lower convection section 48 also helps the operation in the radiant section 3 since radiant tube metal temperature can be reduced. This results in less coking potential in the radiant section. The superheated vapor is then cracked in the radiant section 3 of the furnace 1.

Figure 2:
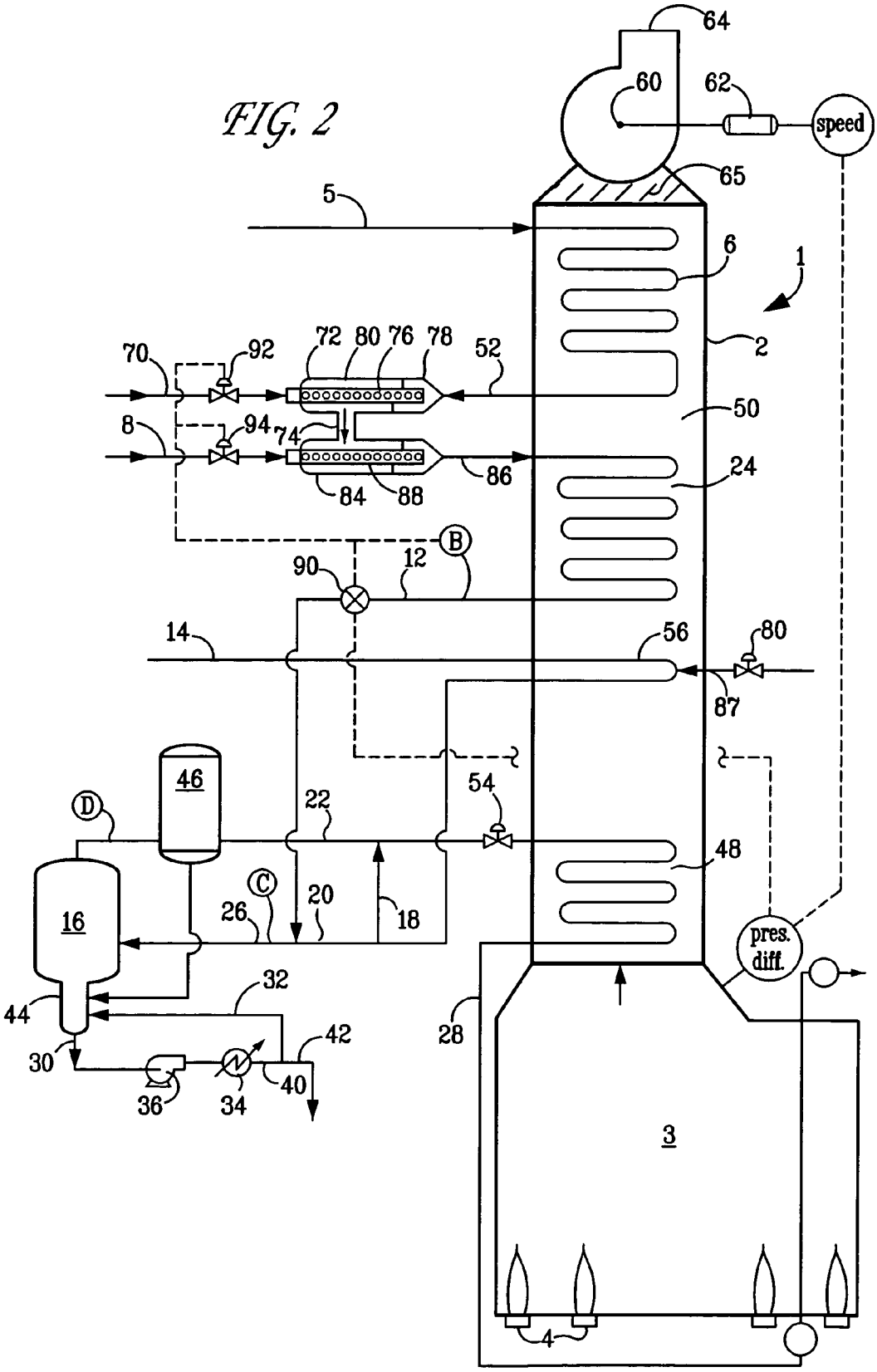
FIG. 2 illustrates a schematic flow diagram of a process and control system of one embodiment of the present invention employing at least one furnace fan, at least one furnace damper and a primary dilution steam stream and a fluid mixed with the heated hydrocarbon feedstock.

In another embodiment of the present invention, as illustrated in FIG. 2, the heated heavy hydrocarbon feedstock stream 52 is also mixed with a fluid 70. It is possible that during start-up of the furnace 1 and during a change in the feedstock that it may be necessary to use the fluid 70 stream and the primary dilution steam stream 8 along with the draft control system described in connection with FIG. 1 to control the temperature B for the hot mixture stream 12 (optionally mixing with the flash steam stream 20) entering the separation vessel 16 to achieve a constant ratio of vapor to liquid in the separation vessel 16, and to avoid substantial temperature and flash vapor to liquid ratio variations.

This may be necessary because, for example, at start-up, very volatile feeds require a separation vessel 16 temperature that is substantially lower than during steady-state operations since the steam to hydrocarbon ratio of the hot mixture stream 12 is higher than during steady-state operations. At minimum flue gas oxygen, fluid 70 may be necessary to achieve the low separation vessel 16 temperature. Also after start-up, during change in feedstock, the lighter feed dilutes the heavy feed resulting in too high of a fraction of the hydrocarbon vaporized in separation vessel 16 without fluid 70. Addition of fluid 70 reduces the temperature of hot mixture stream 12 and the fraction of hydrocarbon vaporized in separation vessel 16.

The fluid 70 can be a liquid hydrocarbon, water, steam, or mixture thereof. The preferred fluid is water. The temperature of the fluid 70 can be below, equal to or above the temperature of the heated feedstock stream 52. The mixing of the heated heavy hydrocarbon feedstock stream 52 and the fluid stream 70 can occur inside or outside the furnace 1, but preferably it occurs outside the furnace 1. The mixing can be accomplished using any mixing device known within the art. However it is preferred to use a first sparger 72 of a double sparger assembly 74 for the mixing. The first sparger 72 preferably comprises an inside perforated conduit 76 surrounded by an outside conduit 78 so as to form an annular flow space 80 between the inside and outside conduit. Preferably, the heated heavy hydrocarbon feedstock stream 52 flows in the annular flow space 80 and the fluid 70 flows through the inside conduit 76 and is injected into the heated heavy hydrocarbon feedstock through the openings 82 in the inside conduit 76, preferably small circular holes. The first sparger 72 is provided to avoid or to reduce hammering, caused by sudden vaporization of the fluid 70, upon introduction of the fluid 70 into the heated heavy hydrocarbon feedstock.

In addition to the fluid 70 mixed with the heated heavy feedstock 52, the primary dilution steam stream 8 is also mixed with the heated heavy hydrocarbon feedstock 52. The primary dilution steam stream 8 can be preferably injected into a second sparger 84. It is preferred that the primary dilution steam stream 8 is injected into the heavy hydrocarbon fluid mixture 52 before the resulting stream mixture 86 enters the convection section 2 for additional heating by radiant section 3 flue gas. Even more preferably, the primary dilution steam stream 8 is injected directly into the second sparger 84 so that the primary dilution steam stream 8 passes through the sparger 84 and is injected through small circular flow distribution holes 88 into the hydrocarbon feedstock fluid mixture.

The mixture of fluid 70, feedstock and primary dilution steam stream (along with the flash stream 20) is then introduced into a separation vessel 16 for, as previously described, separation into two phases: a vapor phase comprising predominantly volatile hydrocarbons and a liquid phase comprising predominantly non-volatile hydrocarbons. The vapor phase is preferably removed from the separation vessel 16 as an overhead vapor stream 22. The vapor phase, preferably, is fed back to the lower convection section 48 of the furnace 1 for optional heating and is conveyed through crossover pipes 28 to the radiant section 3 of the furnace 1 for cracking. The liquid phase of the separation is removed from the separation vessel 16 as a bottoms stream 30.

As previously discussed, the selection of the hot mixture stream 12 temperature B is also determined by the composition of the feedstock materials. When the feedstock contains higher amounts of lighter hydrocarbons, the temperature of the hot mixture stream 12 can be set lower. As a result, the amount of fluid used in the first sparger 72 is increased and/or the amount of primary dilution steam used in the second sparger 84 is decreased since these amounts directly impact the temperature of the hot mixture stream 12. When the feedstock contains a higher amount of non-volatile hydrocarbons, the temperature of the mixture stream 12 should be set higher. As a result, the amount of fluid used in the first sparger 72 is decreased while the amount of primary dilution steam 8 used in the second sparger 84 is increased.

In this embodiment, when a temperature for the mixture stream 12 before the separation vessel 16 is set, the control system 90 automatically controls the fluid valve 92 and the primary dilution steam valve 94 on the two spargers. When the control system 90 detects a drop of temperature of the hot mixture stream 12, it will cause the fluid valve 92 to reduce the injection of the fluid into the first sparger 72. If the temperature of the hot mixture stream 12 starts to rise, the fluid valve 92 will be opened wider to increase the injection of the fluid 70 into the first sparger 72. As described further below, FIG. 2 also illustrates combined control of furnace draft with sparger fluid (preferably water) 70 and primary dilution steam stream 8 using the control system 90 which in addition to communicating with the spargers can also communicate with the draft (pressure differential) measurement device.

In this embodiment, the control system 90 comprises at least a temperature sensor and any known control device, such as a computer application. Preferably, the temperature sensors are thermocouples. The control system 90 communicates with the fluid valve 92 and the primary dilution steam valve 94 so that the amount of the fluid 70 and the primary dilution steam 8 entering the two spargers is controlled. In a preferred embodiment in accordance with the present invention, the control system 90 can be used to control both the amount of the fluid and the amount of the primary dilution steam stream to be injected into both spargers. In the preferred case where the fluid is water, the controller varies the amount of water and primary dilution steam to maintain a constant mixture stream temperature 12, while maintaining a constant ratio of water-to-feedstock in the mixture 11.

When the primary dilution steam stream 8 is injected to the second sparger 84, the temperature control system 90 can also be used to control the primary dilution steam valve 94 to adjust the amount of primary dilution steam stream injected to the second sparger 84. This further reduces the sharp variation of temperature changes in the separation vessel 16. When the control system 90 detects a drop of temperature of the hot mixture stream 12, it will instruct the primary dilution steam valve 94 to increase the injection of the primary dilution steam stream into the second sparger 84 while valve 92 is closed more. If the temperature starts to rise, the primary dilution steam valve 94 will automatically close more to reduce the primary dilution steam stream injected into the second sparger 84 while valve 92 is opened wider.

To further avoid sharp variation of the flash temperature, the present invention also preferably utilizes an intermediate desuperheater 80 in the superheating section 56 of the secondary dilution steam stream 14 in the furnace 1. This allows the superheater outlet temperature to be controlled at a constant value, independent of furnace load changes, coking extent changes, excess oxygen level changes. Normally, this desuperheater 80 ensures that the temperature of the secondary dilution steam 14 is between 800 to 1100° F. (430 to 590°), preferably between 850 to 1000° F. (450 to 540°), more preferably between 850 to 950° F. (450 to 510° C.), and most preferably between 875 to 925° F. (470 to 500° C.).

The desuperheater 80 preferably is a control valve and water atomizer nozzle. After partial preheating, the secondary dilution steam stream 14 exits the convection section and a fine mist of water 87 is added which rapidly vaporizes and reduces the temperature. The steam is then further heated in the convection section. The amount of water added to the superheater controls the temperature of the flash steam stream 20 which is mixed with hot mixture stream 12.

Although it is preferred to adjust the amounts of the fluid and the primary dilution steam streams injected into the heavy hydrocarbon feedstock in the two spargers 72 and 84, according to the predetermined temperature of the mixture stream 12 before the flash drum 16, the same control mechanisms can be applied to other parameters at other locations. For instance, the flash pressure and the temperature and the flow rate of the flash steam 26 can be changed to effect a change in the vapor to liquid ratio in the flash.

Combined control of furnace draft, damper position, sparger fluid (preferably water), secondary dilution bypass flowrate, secondary dilution steam desuperheater water and to a lesser extent separator pressure can effect the optimal separator temperature and gas/liquid split for light but hot feeds such as preheated light crude. In one embodiment, the steps to reach the target separator gas/liquid ratio may be as follows: First, the draft and position of the fan damper(s) 65 and/or flue gas damper(s) can be controlled to minimum flue gas oxygen of about 2%. Second, sparger fluid 70, water, can be maximized with no primary steam 8 flow. Third, water to the secondary dilution steam 14 desuperheater 80 can be maximizes to maximize heat absorbed. Fourth, all of the superheated secondary dilution steam 14 can bypass the separation vessel 16. Fifth, the separation vessel 16 pressure can be raised.

The furnace 1 can also crack hydrocarbon feedstocks which do not contain non-volatiles, such as HAGO, clean condensates or naphtha. Because no non-volatiles deposit as coke in tube bank 24, these feeds are completely vaporized upstream of line 12. Thus, the separation vessel 16 has no vapor/liquid separate function and is simply a wide spot in the line. Typically, the separation vessel 16 operates at 425 to 480° C. (800-900° F.) during HAGO, condensate and naphtha operations.

Without further elaboration, it is believed that one skilled in the art can, using the preceding description, utilize the present invention to its fullest extent. While the present invention has been described and illustrated by reference to particular embodiments, those of ordinary skill in the art will appreciate that the invention lends itself to variations not necessarily illustrated herein. For this reason, then, reference should be made solely to the appended claims or purposes of determining the true scope of the present invention.

We claim:

1. A process for cracking a heavy hydrocarbon feedstock in a furnace having a convection section and a radiant section, said radiant section having radiant section burners which provide hot flue gas in said furnace, said process comprising:

(a) heating said heavy hydrocarbon feedstock in said convection section of said furnace to form a heated heavy hydrocarbon feedstock;

(b) mixing said heated heavy hydrocarbon feedstock with a primary dilution steam stream to form a mixture stream;

(c) heating said mixture stream in said convection section of said furnace to form a hot mixture stream, said hot mixture stream having a vapor phase and a liquid phase;

(d) separating said vapor phase from said liquid phase;

(e) cracking said vapor phase in said radiant section of said furnace to produce an effluent containing olefins; wherein said furnace further has draft and said draft is continuously measured and periodically adjusted to control the temperature of at least one of said hot mixture stream and said vapor phase.

2. The process of claim 1 wherein said furnace has a means for adjusting said draft in said furnace.

3. The process of claim 2 wherein said furnace has at least one furnace fan to control the flow of said hot flue gas in said furnace, and said means for adjusting said draft in said furnace comprises varying the speed of said at least one furnace fan.

4. The process of claim 3 wherein said furnace has at least one furnace damper to control flow of said hot flue gas in said furnace, and said means for adjusting said draft in said furnace further comprises changing the position of said at least one furnace damper.

5. The process of claim 1 wherein said furnace has at least one furnace fan and at least one furnace damper to control flow of said hot flue gas in said furnace, and said draft in said furnace is adjusted by varying the speed of said at least one furnace fan and changing the position of said at least one furnace damper.

6. The process of claim 1 further comprising measuring the temperature of said hot mixture stream before said vapor phase is separated from said liquid phase; comparing the hot mixture stream temperature measurement with a pre-determined hot mixture stream temperature; and adjusting said draft in said furnace in response to said comparison.

7. The process of claim 1 further comprising measuring the temperature of said vapor phase after said vapor phase is separated from said liquid phase; comparing the vapor phase temperature measurement with a pre-determined vapor phase temperature; and adjusting said draft in said furnace in response to said comparison.

8. The process of claim 1 wherein the temperature of said hot mixture stream is further controlled by varying at least one of the flow rate or the temperature of said primary dilution steam stream.

9. The process of claim 1 further comprising mixing said heated heavy hydrocarbon feedstock with a fluid prior to separating said vapor phase from said liquid phase.

10. The process of claim 9 wherein said fluid mixed with said heated heavy hydrocarbon feedstock comprises at least one of liquid hydrocarbon and water.

11. The process of claim 9 wherein the temperature of said hot mixture stream is further controlled by varying the flow rate of said fluid mixed with said heated hydrocarbon feedstock.

12. The process of claim 9 wherein the temperature of said hot mixture stream is further controlled by varying the flow rate of said primary dilution steam stream and the flow rate of said fluid mixed with said heated heavy hydrocarbon feedstock.

13. The process of claim 1 wherein a secondary dilution steam stream is superheated in said furnace and at least a portion of said secondary dilution steam stream is then mixed with said hot mixture stream before separating said vapor phase from said liquid phase.

14. The process of claim 13 wherein the temperature of said hot mixture stream is further controlled by varying the flow rate and temperature of said secondary dilution steam stream.

15. The process of claim 13 wherein at least a portion of said superheated secondary dilution steam stream is mixed with said vapor phase after separating said vapor phase from said liquid phase.

16. The process of claim 1 wherein a secondary dilution steam stream is superheated in said furnace and at least a portion of said secondary dilution steam stream is then mixed with said vapor phase after separating said vapor phase from said liquid phase.

17. The process of claim 1 wherein said vapor phase and said liquid phase of said hot mixture stream are separated in at least one separation vessel.

18. The process of claim 17 wherein said at least one separation vessel is a knock-out drum.

19. The process of claim 1 wherein said vapor phase separated from said liquid phase contains trace liquid, and said trace liquid is removed from said vapor phase in a centrifugal separator prior to cracking said vapor phase in said radiant section of said furnace.

20. The process claim 1, wherein said heavy hydrocarbon feedstock comprises at least one of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, hydrocarbon gases/residue admixtures, hydrogen/residue admixtures, C4's/residue admixture, naphtha/residue admixture, and gas oil/residue admixture.

21. The process of claim 1 wherein the temperature of said heated heavy hydrocarbon feedstock before mixing with said primary dilution steam stream is from 300° F. to 650° F. (150° C. to 340° C.).

22. The process of claim 1 wherein said heavy hydrocarbon feedstock has a nominal final boiling point of at least 600° F. (315° C.).

23. The process of claim 1, wherein the temperature of said hot mixture stream before separating said vapor phase from said liquid phase is from 600° F. to 1040° F. (315° C. to 560° C.).

24. The process of claim 1 wherein said vapor phase and said liquid phase of said hot mixture stream are separated at a pressure of about 40 psia to about 200 psia.

25. The process of claim 1 wherein 40% to 98% of said hot mixture stream is in said vapor phase after being separated from said liquid phase in said at least one separation vessel.

26. The process of claim 1 wherein the temperature of said vapor phase prior to cracking in said radiant section of said furnace is from about 800° F. (425° C.) to about 1300° F. (705° C.).

27. The process of claim 1 further comprising the additional step (f) of quenching said effluent, after said effluent leaves said radiant section of said furnace, using a transfer line exchanger.

* * * * *